US005782123A

United States Patent [19]

Väkiparta

[11] Patent Number: 5,782,123

[45] Date of Patent: Jul. 21, 1998

[54] WORKING TOOL FOR PIPE WALL

[75] Inventor: Tapio Väkiparta, Ulvila, Finland

[73] Assignee: Outokumpu Copper Products OY, Finland

[21] Appl. No.: 820,444

[22] Filed: Mar. 12, 1997

[30] Foreign Application Priority Data

Mar. 15, 1996 [FI] Finland ..... 961218

[51] Int. Cl.[6] ..... B21C 37/20

[52] U.S. Cl. ..... 72/75

[58] Field of Search ..... 72/75

[56] References Cited

U.S. PATENT DOCUMENTS 600,681 3/1898 Sharp ..... 72/75

1,143,101 6/1915 Brinkman ..... 72/75

FOREIGN PATENT DOCUMENTS 11211 1/1990 Japan ..... 72/75

291120 12/1991 Japan ..... 72/75

1404671 9/1975 United Kingdom ..... 72/75

*Primary Examiner*—Lowell A. Larson

*Attorney, Agent, or Firm*—Brooks Haidt Haffner & Delahunty

[57] ABSTRACT

The invention relates to a working tool for working a pipe wall, so that a grooving is created on the inner wall of the pipe. The grooving is carried out by means of a rotating working tool of a grooving machine, and according to the invention, the structure of said tool brings about an efficient use and replacing of the balls provided in the tool for working the pipe to be grooved; it also enables the replacing of the balls without replacing the whole tool.

10 Claims, 2 Drawing Sheets

WORKING TOOL FOR PIPE WALL

Figure 1:
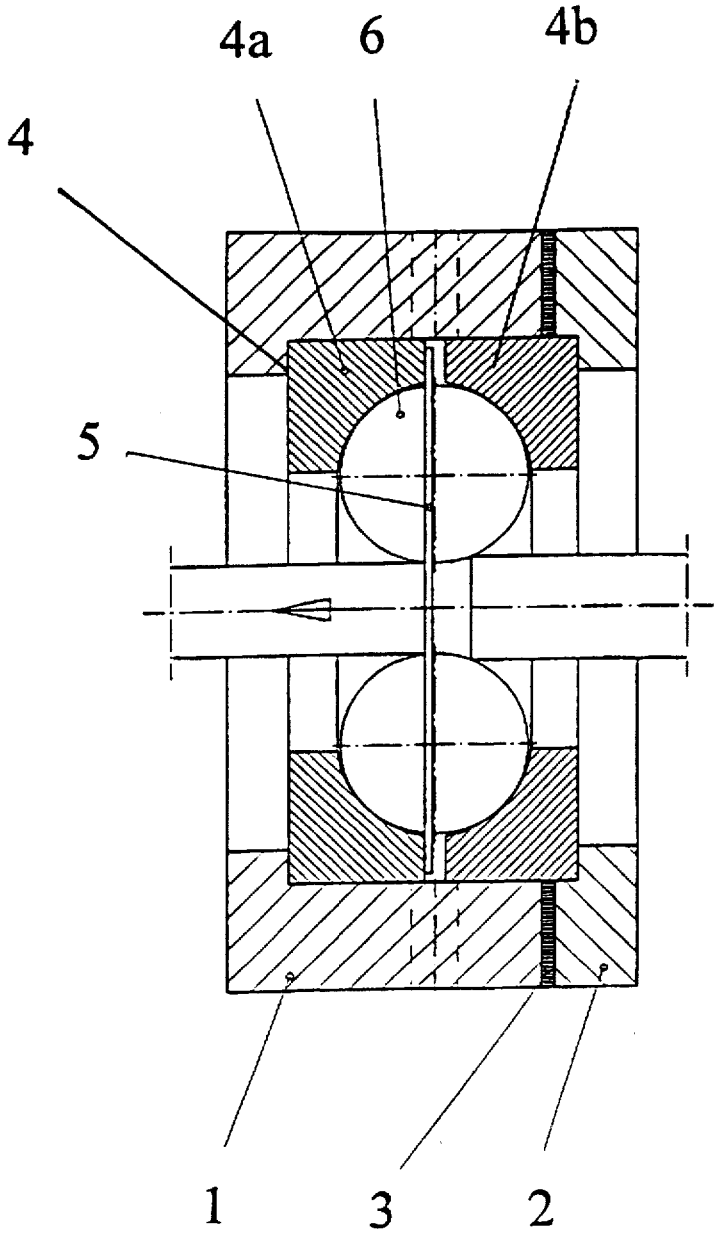

The present invention relates to a working tool for working the wall of a pipe, so that on the inner wall of the pipe there is created a grooving. The grooving is carried out by means of the working tool of a grooving machine, and the structure of the tool according to the present invention brings about an efficient use and replacing of the balls provided in the tool for working the pipe to be grooved; it also enables the replacing of the balls without replacing the whole tool.

A metal pipe with a good thermal conductivity, particularly a copper or aluminum pipe, is used as a heat exchanger element in air conditioning and cooling systems. In order to improve thermal exchange, it has become customary to work the inner wall of the pipe, because it has been found out that the thermal conductivity of a pipe with a grooved inner surface is remarkably higher than that of a smooth pipe. In addition to the working of the inner surface, also the outer surface of the pipe can be worked.

The grooving of a pipe used for thermal exchange is carried out so that the inner surface is worked by inserting in the pipe a grooving mandrel, whereafter the pipe is pressed against the mandrel grooves by means of rollers or balls rotating planetarily around the pipe.

Working with balls is described for instance in the U.S. Pat. No. 4,373,366. The grooving mandrel is at one end attached to a drawing device, which is located prior to the grooving mandrel in the proceeding direction of the pipe. The drawing device is supported in place by means of a draw ring, and the grooving mandrel is surrounded by a rotating working tool arranged around the pipe. Inside the working tool there is provided a groove, a ball casing, with various possible shapes; in this casing, several balls are located in a ring-like fashion around the pipe to be worked. The balls rotating in the ball casing press the pipe towards the grooving mandrel in order to create the grooves. As for the location of the balls, the working tool described in said patent is composed of one part only. The ball casing can be U-shaped or V-shaped. In a U-shaped ball casing embodiment, the balls are pressed towards the narrowing end by means of a push ring. In other structures, no arrangement is suggested for adjusting the location of the balls. In said embodiment, the balls are not easily inserted nor maintained in place without the pipe to be grooved.

A tool used in the grooving of a pipe is also described in the EP application 634,234. The working tool according to this application is characterized in that the inner profile of the one-part ball casing of the working head partly conforms to the curvature of the balls. In its axial cross-section, the groove essentially has the shape of a circular arch, and its degree of curvature is at least the same as that of the balls, so that the radius of curvature of the balls is no more than 5% smaller than the radius of curvature of the circular arch of the ball casing. The cylindrical ball casing is partly closed with a closing element, which is designed so that the balls have a slight axial clearance of a few millimeters. The apparatus according to the EP application is also characterized by the lubrication of the ball casing, which is carried out by means of a tube coaxial with the pipe to be grooved, said tube feeding lubricating oil at the balls.

The tool for working the inner wall of a pipe according to the present invention comprises a housing and a lid of a rotating tool installed at the spot to be worked, a two-part rotation roller frame installed inside the housing as well as a ball holder and balls provided in between the parts of the rotation roller frame. The pipe working tool is located around the pipe, at an essentially same location as the grooving mandrel inside the pipe. Among the advantages of the tool according to the invention let us point out that the balls remain in place during the working process, and the lubrication of the tool is carried out all the more efficiently. By means of adjusting plates provided in between the housing and the lid of the working tool, the axial distance of the rotation roller frames from each other can be accurately adjusted, and the wall thickness of the pipe can also be controlled. The essential novel features of the invention are apparent from the appended claims.

Figure 2:
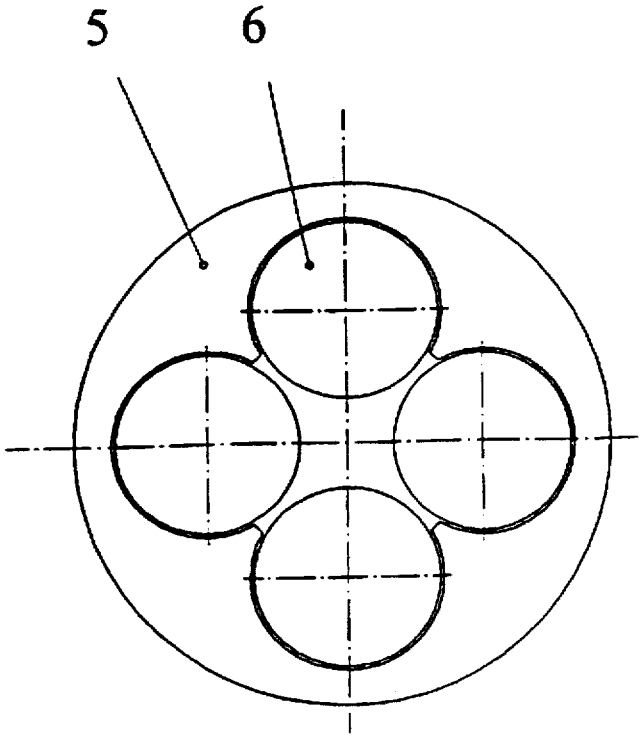
Figure 3:
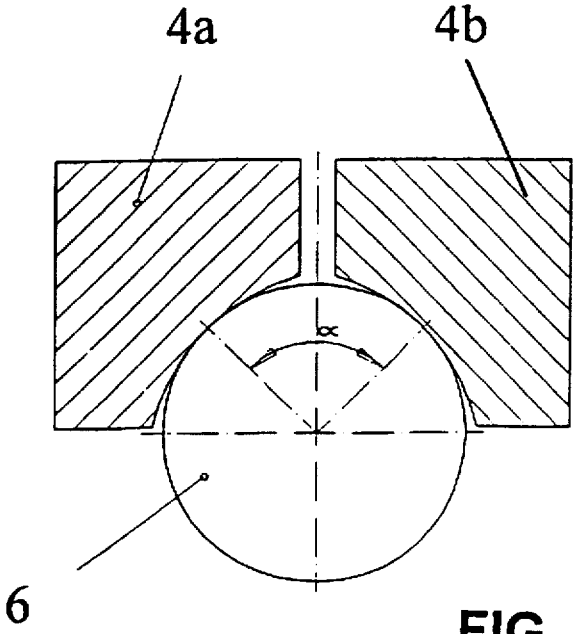

The advantageous tool according to the invention is further described with reference to the appended drawings, wherein FIG. 1 illustrates the working tool according to the invention seen in side-view cross-section, FIG. 2 illustrates a part of the working tool, i.e. the ball holder, seen at the front, and FIG. 3 is a schematic illustration of one ball of the working tool as well as the parts of the rotation roller frame that come into contact with said ball, seen in cross-section.

The working tool according to the invention is not described in detail throughout the whole working process, because the principles are already known for instance from the apparatuses outlined in the description of the prior art. As is seen in FIG. 1, the working tool of a pipe to be grooved first of all comprises a housing 1, hollow in the middle and cylindrical in the working direction thereof, as well as a lid element 2 attachable thereto, likewise provided with a clearance in the middle, the diameter of said clearance being at least equal to the diameter of the pipe. In the middle of the figure we see a schematic illustration of the pipe to be worked, as well as the proceeding direction thereof. Inside the pipe, essentially at the working head, there is provided a grooving mandrel which is not illustrated in the drawing.

The distance between the housing 1 and the lid 2 of the working head is adjustable by means of one or several adjusting plates 3 installed in between the housing and the lid. The adjusting plates are used for changing the mutual axial distance of the rotation roller frames. When the mutual axial distance of the rotation roller frames is changed, also the radial location of the ball radial is changed; this is one of the procedures whereby the fine adjustment of a pipe is carried out essentially by using a tool according to the invention. The accuracy of the adjustment may be increased up to 0.005 mm by changing the number or thickness of the adjusting plates. When the total thickness of the adjusting plates increases, the pipe wall thickness also increases.

In the space provided inside the housing 1 and lid 2 of the working head, there is fitted the rotation roller frame 4 composed of two opposite parts **4*a*, 4*b*, which are essentially similar in shape. The rotation roller frame is coaxial with the housing and the lid. The interior of the rotation roller frame parts is so designed that each of the parts forms a circular arch having a segment within the range 30°–90° in the axial direction. The rotation roller frame parts located opposite to each other are not fitted tightly together, but in between there remains a clearance which is 8–12%, advantageously about 10% of the diameter of the balls 6 to be placed inside the rotation roller frame 4**.

The two-part rotation roller frame makes it possible that in between the frames, there can be installed a ball holder 5, formed of a thin plate with a thickness of roughly 1 mm and an outer diameter roughly equal to the outer diameter of the rotation roller frame. The shape of the ball holder 5 is clearly seen in FIG. 2. Inside the ball holder there is formed a clearance with a shape depending on the number of the working balls. The edge of the clearance runs along the form of the circular arch determined by the diameter of each ball, so that it is essentially equal throughout a length which is at least 55% of the circular arch of the diameter of each ball. Owing to the ball holder, the balls remain in their position when starting the job, and stay apart during the working process.

The clearance left in between the rotation roller frame parts is significant from the point of lubrication, too, because it enables an efficient removal of oil from the spot under treatment. The oil fed in the working spot both lubricates and cools. Because the oil can now be effectively removed through the clearance left in between the rotation roller frame parts, the oil circulation can be altered according to the cooling needs without causing inconvenience for the working process. Also the ball holder is designed so that it does not hamper the proceeding of oil.

In the EP application 634,234 referred to in the description of the prior art it is considered an advantage that the contact between the rotation roller frame and the balls is more than spot-like, in which case the diameter of the rotation roller frame is no more than 5% larger than that of the ball; however, so close a contact did not appear advantageous when developing the apparatus of the present invention. On the contrary, in our development work it was considered an advantage that if the radius of the rotation roller frame is 7–15%, advantageously 8–12% larger than the ball radius, also the fine adjustment of the pipe wall can be accomplished by changing the adjusting plates according to the method described above. In addition to the fine adjustment, the difference in the radii results favorably in that possible impurities, such as metal scales, contained in the lubrication oil do not hamper the rotation of the balls.

As was already mentioned, it has been proved advantageous to form the radius of the rotation roller frame somewhat larger than the ball radius, which results in that the contact of the ball with both parts of the rotation roller frame is spot-like. In FIG. 3 it is seen that the spot-like contact points of the ball and the rotation roller frames together with the ball center form an angle which is called the roller angle $\alpha$. We have found out that the roller angle $\alpha$ must be within the range 75°–110°, advantageously within the range 80°–105°. A smaller roller angle is not advantageous owing to an increased risk of ball-slipping, and a larger angle leads to a remarkably higher degree of wearing than operating within said range.

The size and number of the balls can be varied within the scope of the working tool according to the invention, depending on the desired wall thickness of the pipe under treatment etc. The number of the balls may vary between 3–6, and a ball holder of the suitable shape is respectively installed. Likewise, the ball diameter may vary between 15–25 mm. An advantage of balls with a diameter larger than 15 mm is that the gap angle between the pipe under treatment and the ball becomes sufficiently small, and as a result the moment of rotation of the pipe remains small. It is advantageous to choose the ball diameter to be as large as the number of the balls allows. The number of the balls is chosen according to the pipe diameter.

The working tool according to the invention is stable and allows a high speed of rotation. Also the durability of the tool has turned out to be of a high quality. It has been proved that the same balls have been used for manufacturing even more than 100 tons of pipe, and here it is pointed out that the balls are the most frequently replaced parts of the tool. The balls are standard balls that are readily available from bearings manufacturers. The novel tool of the present invention is small in size and rapidly replaceable.

I claim:

1. A rotating working tool for grooving the inner surface of a pipe, which tool comprises a cylindrical housing (1) open around its axis to receive a pipe to be grooved, a circular rotation roller frame (4) arranged coaxially inside the housing (1), and balls (6) contacting the inside of the rotation roller frame (4), characterized in that one end of the housing (1) is locked with a lid (2) open around its axis, the rotation roller frame (4) having a circular inner surface and being installed inside the housing (1), the roller frame being composed of two parts (**4*a*, 4*b*), in between which parts there is disposed a ball holder plate (5) to keep the balls (6**) in place.

2. A working tool according to claim 1, characterized in that the distance between the housing (1) and the lid (2) is adjustable by an adjusting plate (3) provided therebetween.

3. A working tool according to claim 2, characterized in that the strength and number of the adjusting plates (3) can be varied.

4. A working tool according to claim 1, characterized in that the rotation roller frame parts (**4*a*, 4*b*), are essentially similar in shape and are located in the housing (1) opposite to each other and with a space between the frame parts of 8–12% of the diameter of the balls (6**).

5. A working tool according to claim 1, characterized in that the inner surfaces of both parts (**4*a*, 4*b*) of the rotation roller frame (4**) form a circular arch constituting a segment of 30°–90° in the axial direction.

6. A working tool according to claim 1, characterized in that the radius of the rotation roller frame (4) is 7–15% larger than the radius of the balls (6).

7. A working tool according to claim 1, characterized in that the radium of the rotation roller frame (4) is 8–12% larger than the radius of the balls (6).

8. A working tool according to claim 1, characterized in that the contact point of the rotation roller frame parts (**4*a*, 4*b*) and the balls (6**) is spot-like.

9. A working tool according to claim 8, characterized in that the roller angle $\alpha$, formed by the contacts between the rotation roller frame parts (**4*a*, 4*b*) and the balls (6**) with the midpoint of the balls, falls within the range 75°–110°.

10. A working tool according to claim 1, characterized in that in the middle of the ball holder plate (5), there is provided a clearance with an edge of an essentially equal length along a distance which is at least 55% of the circular arch determined by the diameter of each ball.

* * * * *

UNITED STATES PATENT AND TRADEMARK OFFICE

CERTIFICATE OF CORRECTION

PATENT NO. : 5,782,123

DATED : July 21, 1998

INVENTOR(S) : TAPIO VÄKIPARTA

It is certified that error appears in the above-indentified patent and that said Letters Patent is hereby corrected as shown below:

Column 4, line 44, change "radium" to --radius--.

Signed and Sealed this

Seventeenth Day of November, 1998

Bruce Lehman

*Attest:*

BRUCE LEHMAN

*Attesting Officer*

*Commissioner of Patents and Trademarks*